US009439520B2

(12) United States Patent
Berry et al.

(10) Patent No.: US 9,439,520 B2
(45) Date of Patent: Sep. 13, 2016

(54) MERCHANDISER FOR DISPLAYING ITEMS AT AN ANGLE

(71) Applicant: HALLMARK CARDS, INCORPORATED, Kansas City, MO (US)

(72) Inventors: Todd E. Berry, Kansas City, MO (US); Brian Bertram Owens, Kansas City, MO (US); Joseph G. Blincoe, Olathe, KS (US); Jimmy J. D. Leeper, Leawood, KS (US); Doug Bazzel, Shawnee, KS (US)

(73) Assignee: HALLMARK CARDS, INCORPORATED, Kansas City, MO (US)

( * ) Notice: Subject to any disclaimer, the term of this patent is extended or adjusted under 35 U.S.C. 154(b) by 0 days.

(21) Appl. No.: 14/628,026

(22) Filed: Feb. 20, 2015

(65) Prior Publication Data

US 2015/0230629 A1 Aug. 20, 2015

Related U.S. Application Data

(60) Provisional application No. 61/942,529, filed on Feb. 20, 2014.

(51) Int. Cl.

| | |
|---|---|
| ***A47F 5/08*** | (2006.01) |
| ***A47F 5/00*** | (2006.01) |
| ***A47F 7/14*** | (2006.01) |

(52) U.S. Cl.

CPC ..... *A47F 5/0815* (2013.01); *A47F 5/0018* (2013.01); *A47F 7/147* (2013.01); *A47B 2220/0083* (2013.01)

(58) Field of Classification Search

CPC .... A47F 5/0846; A47F 5/112; A47F 5/0025; A47F 5/0815; A47F 5/0018; A47F 7/146; A47F 7/147; A47F 7/14; A47F 7/145; A47B 43/00; A47B 43/02; A47B 2220/0083; G11B 23/023; G11B 23/0236; B42F 7/145; B42F 15/007; B42F 15/0076; B42F 15/0082; B42F 15/0088; B42F 15/0094

USPC ..... D19/90

See application file for complete search history.

(56) References Cited

U.S. PATENT DOCUMENTS 1,270,718 A * 6/1918 Ford ..... A47B 13/081 105/425

3,031,088 A * 4/1962 Ribbens ..... A47B 57/402 211/182

(Continued)

OTHER PUBLICATIONS

Hallmark Cards, Incorporated Halloween, Oct. 31, 1989 Catalog, 1 page.

(Continued)

*Primary Examiner* — Patrick Hawn

(74) *Attorney, Agent, or Firm* — Shook, Hardy & Bacon L.L.P.

(57) ABSTRACT

A merchandiser for displaying items at an angle with respect to a rear panel of a display fixture is formed from flat sheets. The merchandiser has first and second side panels separated by a bottom panel along first and second fold lines that are generally parallel to each other. The first and second panels are offset from each other and may be folded toward each other to a generally parallel orientation. The merchandiser has tabs extend from a rear thereof that may be received in slots in the rear panel of the fixture to couple the merchandiser thereto. The merchandiser is reversible and may be folded into a functional form which angles to either the right or the left with respect to the panel to which they are coupled to allow customers to easily view the front of items held therein while still maintaining a high density of display.

20 Claims, 8 Drawing Sheets

(56) References Cited

U.S. PATENT DOCUMENTS 3,047,158 A * 7/1962 Scholl ..... B42F 7/145 211/126.13
3,216,426 A * 11/1965 Furrer ..... B42F 7/145 211/113
4,228,906 A * 10/1980 Jones ..... A47F 5/0025 108/180
4,573,588 A * 3/1986 Cohen ..... G11B 23/0236 211/40
4,584,950 A * 4/1986 Adams ..... G11B 23/0236 211/40
4,684,030 A * 8/1987 Gurzynski ..... A47F 7/146 211/40
4,815,611 A * 3/1989 Gurzynski ..... A47F 7/146 211/41.12
5,335,797 A * 8/1994 Myers ..... B42F 17/08 211/103
5,836,459 A * 11/1998 Nezwek ..... A47F 5/01 211/106
5,993,099 A * 11/1999 Greenberg ..... B42F 15/0064 211/42
6,471,080 B1 * 10/2002 Hoffmann ..... A47B 63/00 211/126.1
7,987,998 B1 8/2011 Belk et al.
7,987,999 B2 8/2011 Weigand et al.
8,172,093 B1 5/2012 Belk et al.
8,684,193 B1 * 4/2014 Sharon ..... B65D 5/0227 211/73
2014/0014601 A1 1/2014 Weigand

OTHER PUBLICATIONS

Hallmark Crown, Integration, Merchandising Product System Enhancements, dated 1994, 1 page.

* cited by examiner

MERCHANDISER FOR DISPLAYING ITEMS AT AN ANGLE

CROSS-REFERENCE TO RELATED APPLICATIONS

This application claims the benefit of U.S. Provisional Application No. 61/942,529, filed Feb. 20, 2014, entitled "Merchandiser for Displaying Items at an Angle," which is hereby expressly incorporated by reference in its entirety.

STATEMENT REGARDING FEDERALLY SPONSORED RESEARCH OR DEVELOPMENT

Not applicable.

TECHNICAL FIELD

The present invention is a merchandiser. More particularly, the present invention is an object designed to support and display items, generally for sale in a retail environment.

BACKGROUND

Numerous methods have been developed for displaying retail items. In the greeting card field, for example, greeting cards are normally displayed in rows on shelves that are attached to fixtures. The rows are often divided into individual pockets and receive greeting cards and corresponding envelopes therein. Greeting cards can be displayed in a full facing manner, where the rows are spaced sufficient distances from one another vertically so that the top of a displayed card is below the bottom of the row directly there above. This method of display allows a customer to have a clear view of the entire face of the card without removing the card from the shelf. Full faced card display, however, reduces the number of cards that can be displayed in a given area. More commonly, greeting cards are displayed in a partial face display where the rows are spaced apart vertically such that only the top half of a greeting card positioned therein is visible. This method allows more cards to be displayed in a given area. The bottom half of the card, however, is covered up by the top half of the cards in the row directly below. In order to view the entire face of the card, a customer must remove the card from the shelf. It is therefore desirable to develop a manner of displaying greeting cards that offers the visual benefits of a full faced display as well as the higher density provided by traditional partial displays. These benefits are achieved in the present invention.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Embodiments of the present invention are directed to a merchandiser for supporting and displaying items, such as greeting cards, in a retail environment. More particularly, the merchandiser may be configured to display greeting cards on a fixture at an angle. In such a configuration, the merchandisers may be arranged to overlap greeting cards in a horizontal arrangement such that a customer may view the majority of the front of the card as they walk by the display (similar to a full face display), but card density may be maintained (similar to a partial face display).

BRIEF DESCRIPTION OF THE SEVERAL VIEWS OF THE DRAWINGS

The present invention is explained in more detail with reference to the embodiment illustrated in the attached drawing figures, in which like reference numerals denote like elements, in which FIGS. 1-8 illustrate but one possible embodiment of the present invention, and in which:

FIG. 1 is a top rear perspective view of an unassembled merchandiser in accordance with an embodiment of the present invention;

FIG. 2 is a enlarged view of area 2 of FIG. 1 in accordance with an embodiment of the present invention;

FIG. 3 is a top plan view of the unassembled merchandiser of FIG. 1;

FIG. 4 is a top front perspective view of the merchandiser of FIG. 1 in an assembled state;

FIG. 5 is a front elevation view of two assembled merchandisers coupled with a panel in accordance with an embodiment of the present invention;

FIG. 6 is an front right perspective view of three assembled merchandisers coupled with a panel in accordance with an embodiment of the present invention;

FIG. 7 is a front elevation view of an exemplary retail greeting card display including a segment with a full facing arrangement on the left, a segment with a partial facing arrangement in the center, and a segment with an angled arrangement utilizing merchandizers in accordance with an embodiment of the present invention on the right;

FIG. 8 is an enlarged view of the right section of FIG. 7 illustrating merchandizers in angled arrangements in accordance with an embodiment of the present invention.

DETAILED DESCRIPTION

Provided herein is a merchandiser which may be used, for instance, in a commercial setting, such as a retail store, to hold and display greeting cards and other merchandise that are for sale. The merchandiser is designed to display cards at an angle with respect to a rear panel of a display. The merchandisers are manufactured as flat sheets which may be shipped and stored in stacks to reduce costs. These flat sheets are reversible and may be folded into a functional form which angles to either the right or the left with respect to the panel to which they are coupled. The merchandisers may be made of transparent material to allow customers to view the merchandise through the side panels of the merchandisers. An angled arrangement of merchandisers allows customers to easily view the front of the cards held therein while still maintaining a high density of display.

Figure 1:
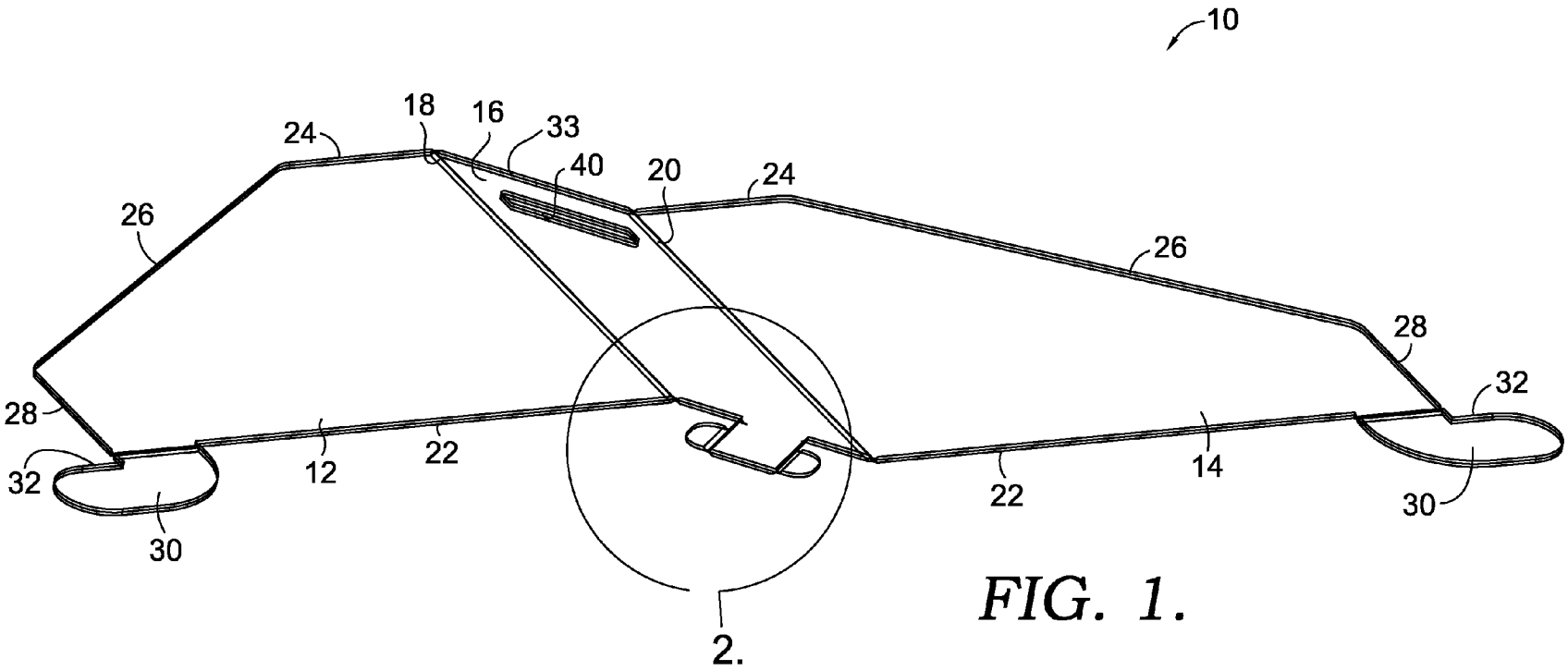

Referring now to the drawings, wherein like reference characters designate like parts through the different views, and initially to FIG. 1, numeral 10 generally represents a merchandiser in accordance with a first embodiment of the present invention. The merchandiser 10 preferably has a planar or flat unassembled configuration, as depicted in FIG. 1, which is a top rear perspective view. The merchandiser 10 may be comprised of a transparent plastic material. The merchandiser 10 may be formed by an injection molding process or, alternatively, may be formed by die cutting the shape of the merchandiser from a flat sheet of material. In an embodiment where the merchandiser 10 is formed by an injection molding process, the merchandiser may be comprised of a plastic or copolymer such as, for example, styrene-butadiene copolymers (SBC) or polycarbonate. One commercially available material is sold by BASF under the trademark Styrolux®. If manufactured by the injection molding process, areas of reduced thickness can be created to create fold lines (or a hinge), as will be discussed below. In an embodiment where the merchandiser 10 is formed by die cutting, the merchandiser may be cut from sheets of material such as, for example, polyethylene terephthalate (PET), polyvinyl chloride (PVC), or polyethylene (PE). In the die-cutting process, the fold lines could be created by partial or perforation cuts made where fold lines are desired.

The merchandiser 10 is preferably made flat such that it may be shipped to a location for use in a compact, unassembled format. Specifically, numerous merchandisers, while flat, may be stacked upon one another and shipped to a location for use. This is in contrast to prior art merchandisers that are made in a final use shape by injection molding a rigid plastic which must then be shipped assembled. Such preformed merchandisers take up significantly more space, requiring more packaging to ship, thus increasing shipping costs, and more space to store when not in use.

Figure 3:
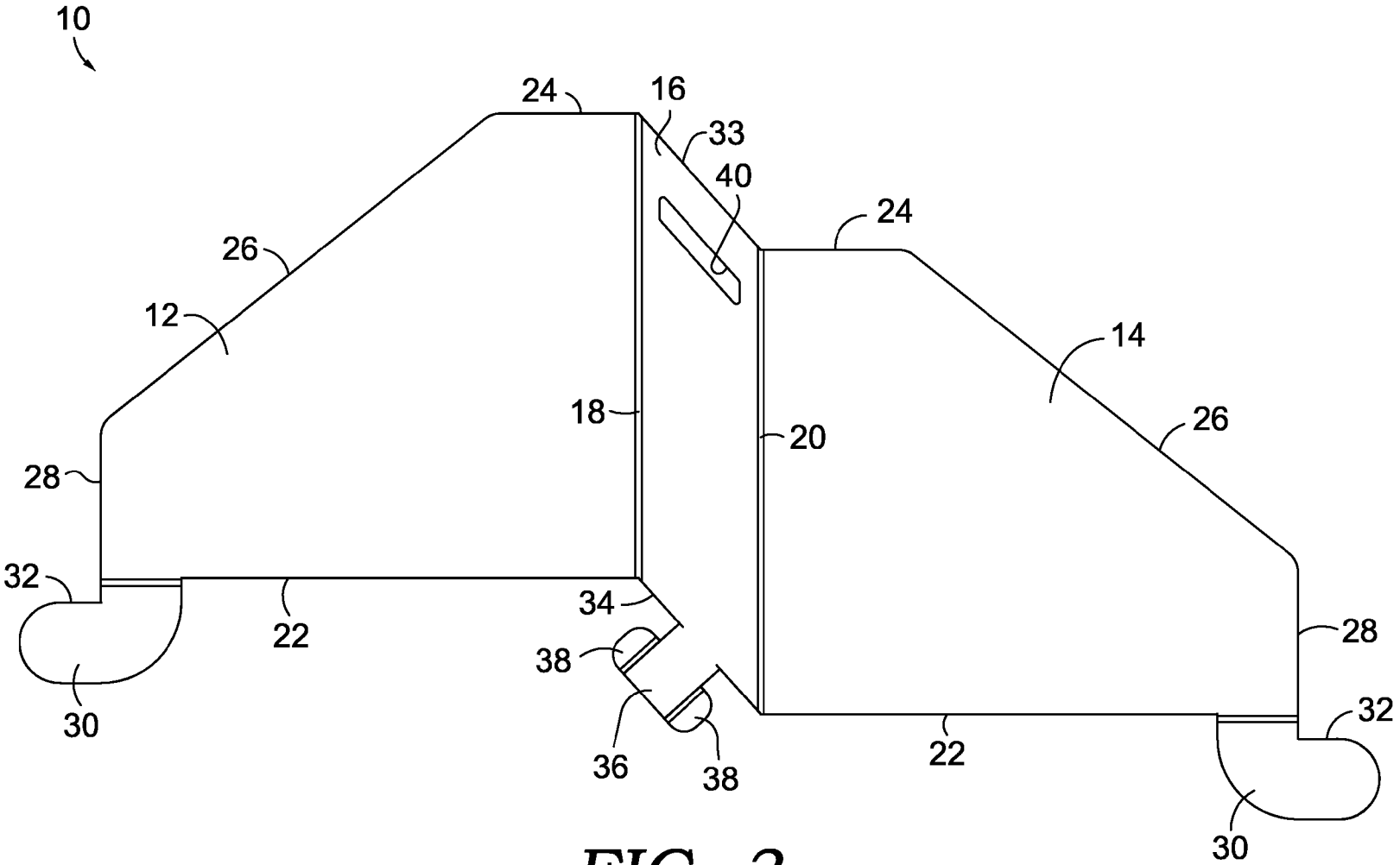
Figure 4:
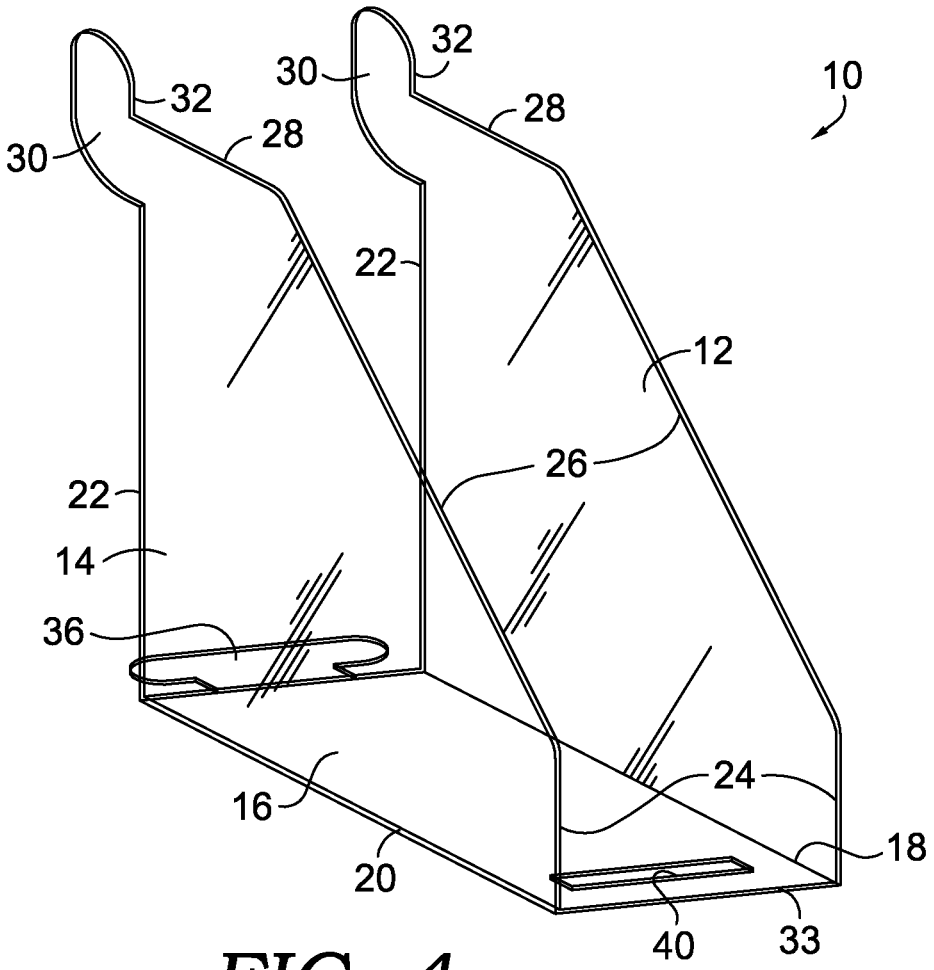

The merchandiser 10 includes first and second side panels 12, 14 separated by an intermediate bottom panel 16. The bottom panel 16 may generally have a parallelogram shape, which contributes to the merchandiser's angled orientation once coupled to a display fixture. The first panel 12 is coupled with the bottom panel 16 along a first fold line or hinge 18. Similarly, the second panel 14 is coupled along an opposite edge of the bottom panel 16 by a second fold line 20. The first and second fold lines 18, 20, as best viewed in the plan view depicted in FIG. 3, are generally parallel to one another. When the merchandiser 10 is folded into its functional form, the side panels 12, 14 become generally parallel to each other, as is illustrated in FIG. 4.

Figure 5:
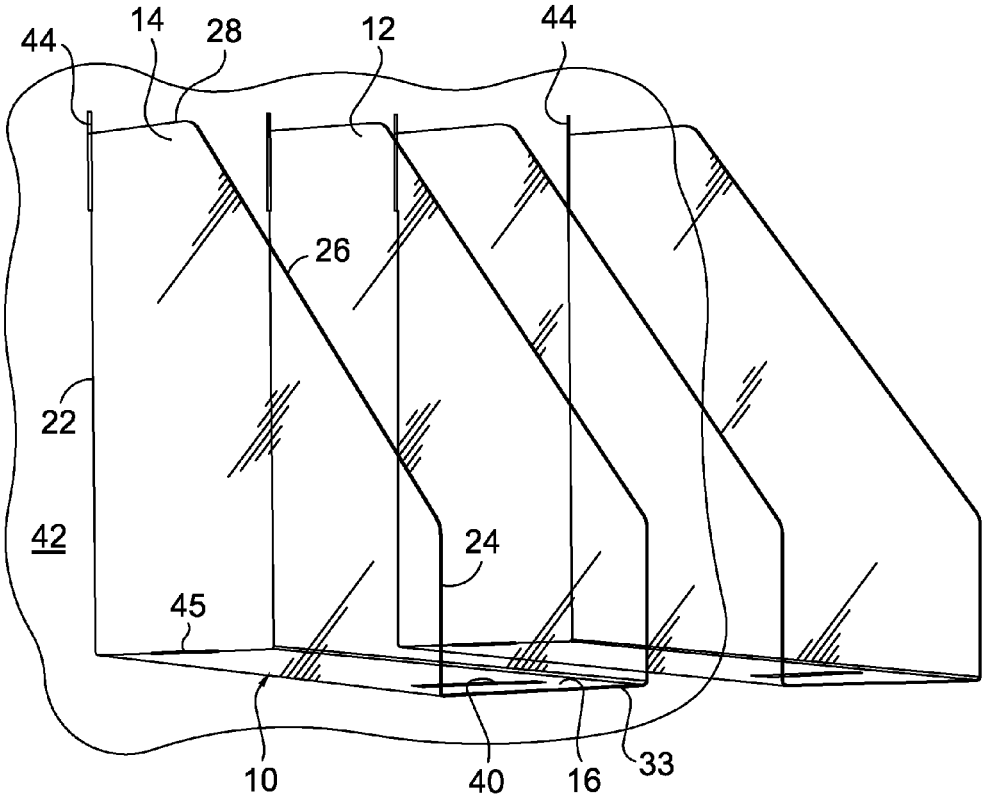

As illustrated in FIG. 3, the first and second panels 12, 14 are essentially the same shape and are mirror images of one another. In that regard, they both include a rear edge 22 which extends generally perpendicular to the fold lines 18, 20, and that, during use, abuts a rear wall or panel of a display to which the merchandiser 10 is coupled during use. Each panel 12, 14 also provides a front edge 24 opposite and generally parallel to the rear edge 22, which extends generally perpendicular to the fold lines 18, 20. An upper edge 28 of each panel extends perpendicularly from the rear edge 22 and parallel to the fold lines 18, 20. Each side panel 12, 14 also has a sloped edge 26 extending between the front edge 24 and upper edge 28, such that both entire side panels 12, 14 generally form an irregular pentagon. Additionally, both of the panels 12, 14 include, extending outwardly from the rear edge 24 adjacent the upper edge 28, a tab 30. The tabs 30 help in coupling the merchandiser 10 to the rear wall panel of the fixture or display by receipt in vertical slots 44 therein, as depicted in FIG. 5. A front edge 32 of each tab 30 abuts a rear surface of the panel and resists the forces which attempt to pull the upper portion of the merchandiser away from the panel when items are placed in the merchandiser. The tabs 30 may have rounded edges to facilitate insertion into the slots.

Figure 2:
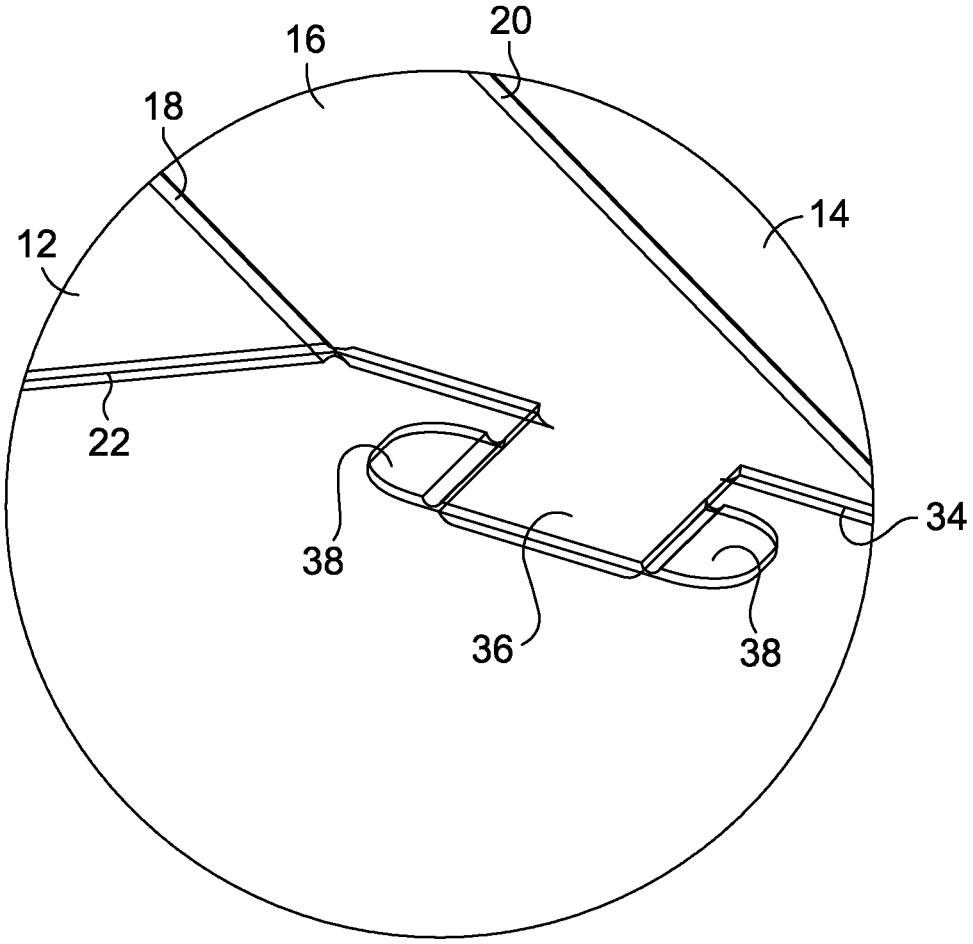

In use, the bottom panel 16 is generally horizontal in orientation and is generally perpendicular to the panel or back wall to which it is coupled. As best seen in FIG. 2, a rear edge 34 of the bottom panel 16 includes a projection 36 that has a pair of opposed ears 38. The projection 36 and the ears 38 are received in a horizontal slot 45 in the panel or back wall of the fixture. The ears 38 may be folded in toward each other for receipt in the slot 45 which is slightly wider than the width of the body of the projection 36. Once the projection 36 is received in the slot sufficiently far such that ears 38 are behind the panel, the ears, due to the resilient nature of the material from which the merchandiser 10 is formed, will move back towards the rest position illustrated in FIG. 2. Accordingly, the ears 38 act to prevent withdrawal of the projection 36 from cooperation with the panel. The bottom panel 16 may include an opening 40 therein near a front edge 24 of the panel 16. The opening 40 may receive tabs of signage to couple informational signs 46 to the bottom of the merchandiser 10.

Another benefit of forming the merchandiser 10 flat is that the same merchandiser 10 may be coupled to the display in a manner where it angles off to the left when viewing the display or it may be coupled to the display in a manner where it angles off to the right when viewing the display. To form the merchandiser 10 to angle to one side, the panels 12, 14 are folded up toward each other when viewed in FIG. 3. To form the merchandiser 10 to angle to the other side, the panels 12, 14 are folded down toward each other when viewed in FIG. 3. This prevents having to ship two different types of merchandisers.

FIG. 4 is a top front perspective view of a merchandiser 10 folded into its functional form. The merchandiser 10 is angled to the right as it would be if installed in a display fixture.

FIG. 5 is a front elevation view illustrating two merchandisers 10 of the present invention installed into a panel or rear wall 42 of a fixture for use. The material from which the merchandisers 10 are formed is preferably transparent so that merchandise such as greeting cards may be viewed through the merchandiser 10. Each of the merchandisers 10 in this view are tilted to the right. This view also illustrates the vertical slots 44 and horizontal slots 45 in the panel 42 into which the tabs 30 and projections 36, respectively, are received to couple the merchandiser 10 to the panel 42 of the display fixture.

Figure 6:
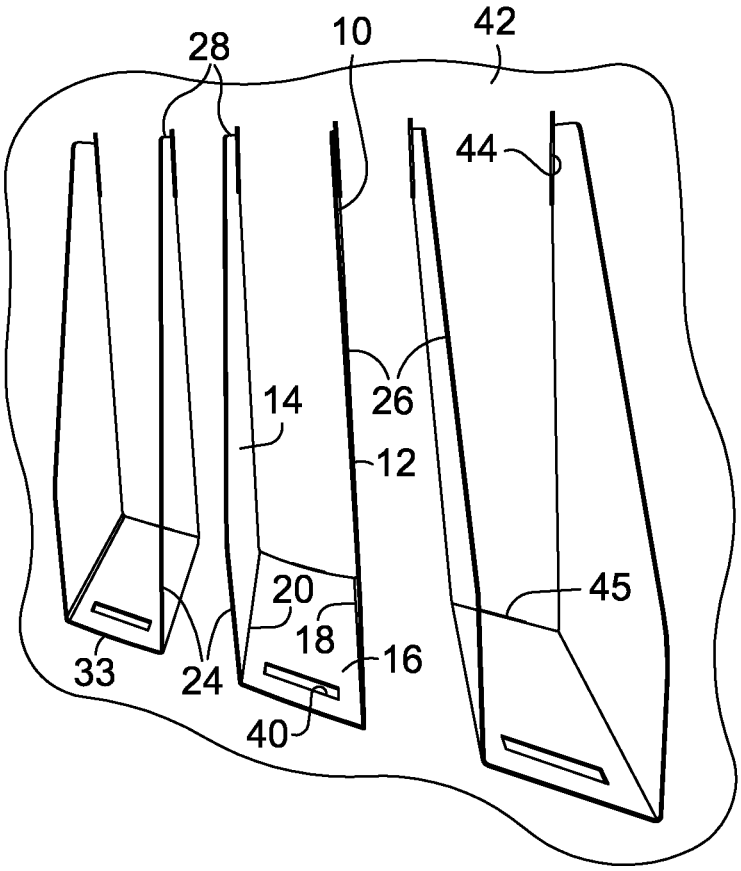

FIG. 6 is a front right perspective view illustrating three merchandisers 10 of the present invention installed into a panel or rear wall 42 of a fixture for use. The merchandisers in this view are also tilted to the right.

Figure 7:
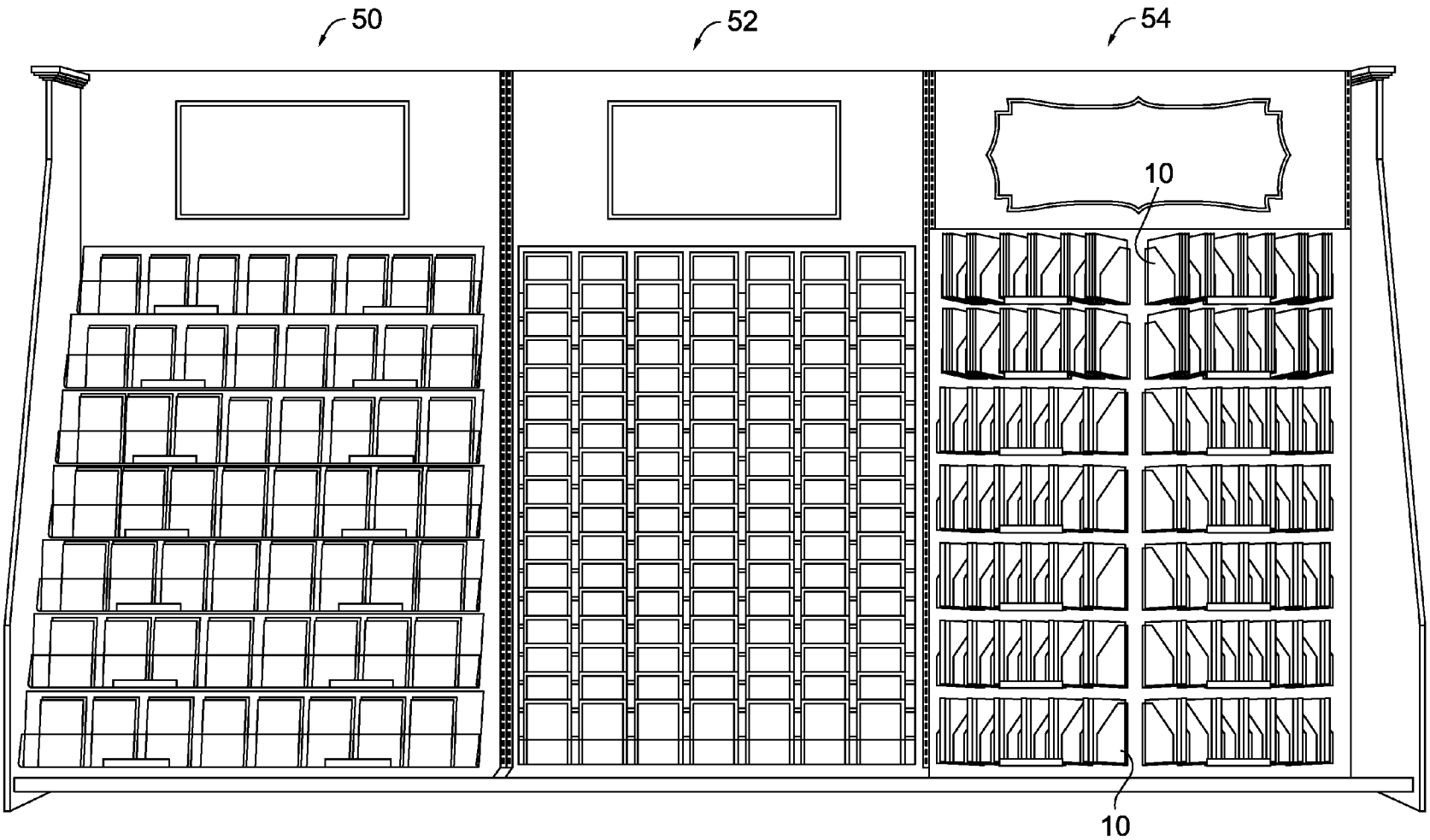

FIG. 7 is a front elevation view of a retail greeting card display. At a left section, greeting cards are displayed in a generally full facing arrangement 50 on a standard shelf display. In this configuration a customer may view the entire face of each card but only 7 rows of 8 cards fit in the display. Greeting cards in a center section are displayed in a partial face display 52. The density of the display is increased significantly due to vertical overlapping, such that 17 rows of 7 cards fit in the display area, more than doubling the number of cards in the display compared to the full facing arrangement 50. However, less than half of the top of the cards not on the bottom row are visible without removing the card from the display. The merchandiser 10 of the present invention is used in a right section in an angled display 54. In the angled display 54, a customer may view the majority of the face of the cards as they walk by and view the display from different angles without having to remove the card from the display. The angled display 54 using the present merchandiser 10 is able to display 7 rows of 12 cards, a 50% increase in density over the full face display. Thus, the angled display 54 offers the benefit of increased visibility of cards or merchandise on display while still providing higher display density.

Figure 8:
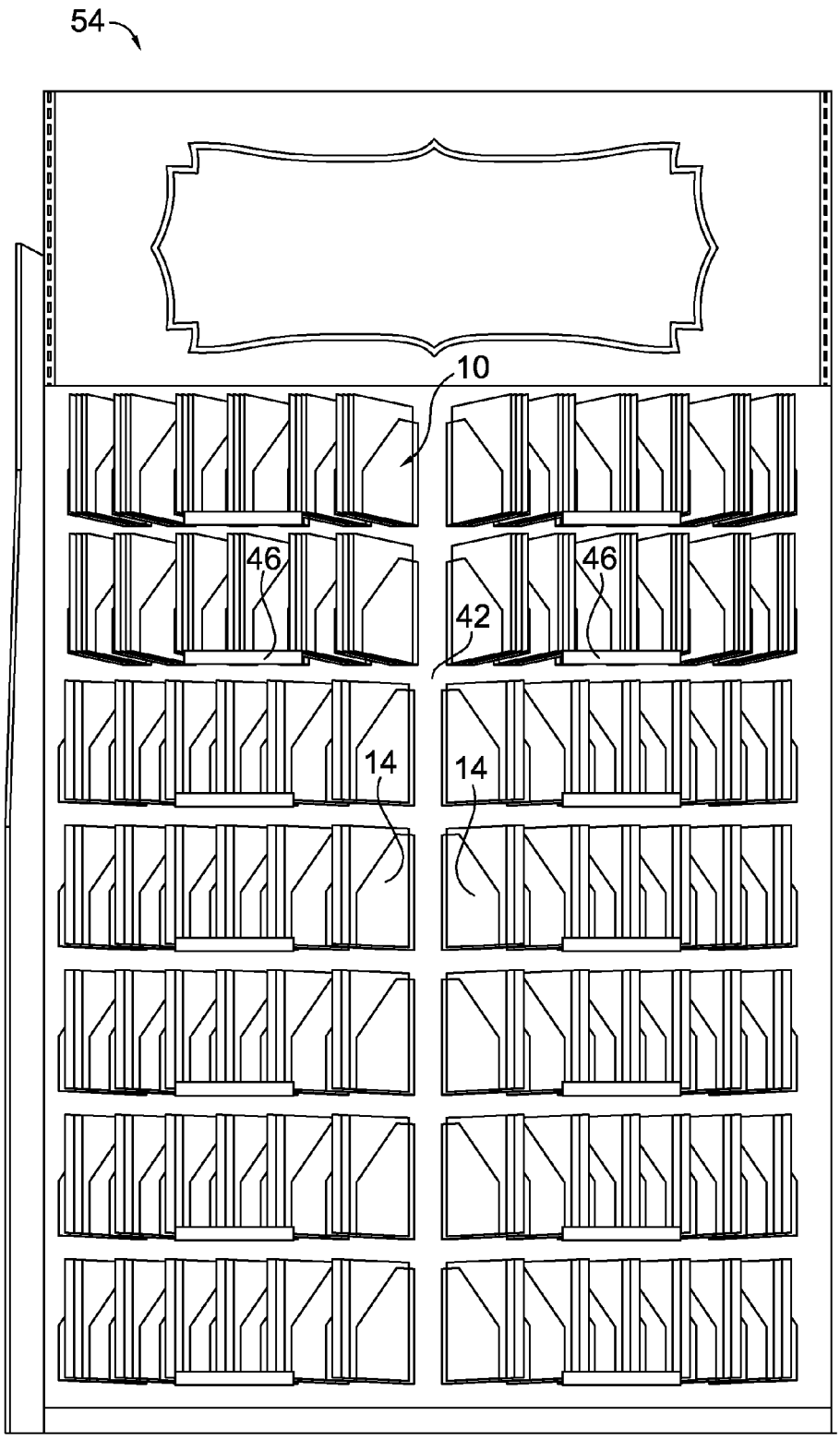

FIG. 8 is an enlarged view of an angled display 54, illustrating how the merchandiser 10 of the present invention may be angled to either the left or the right. The merchandiser 10 is reversible such that side panel 14 is always in the foreground compared to side panel 12 when coupled to a rear panel 42 of a display fixture. Optional informational signs 46 are depicted below some of the merchandisers 10.

It should be noted that while the invention has been described and illustrated in the context of holding or displaying greeting cards, it is not so limited. The merchandiser 10 may display all types of merchandise, such as, but not limited to, stationery, invitations, books, journals, giftwrap, paper, folders, pictures, etc.

Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims.

The invention claimed is:

1. A merchandiser for displaying items at a non-perpendicular angle with respect to a rear panel of a fixture to which the merchandiser may be attached for use, the merchandiser comprising:

a generally planar and unitary sheet having first and second side panels separated by a bottom panel, wherein the first side panel is coupled to the bottom panel along a first fold line and wherein the second side panel is coupled to the bottom panel along a second fold line, the first and second fold lines being non-perpendicular relative to front and rear edges of the bottom panel, wherein the first and second fold lines are generally parallel to each other, wherein the first and second side panels are mirror images of each other, wherein the first and second side panels each include a tab extending from a rear edge thereof, wherein the first and second side panels may be folded up toward each other to a first generally parallel configuration to provide a first non-perpendicular angle of display relative to the rear panel of the fixture or folded down toward each other to a second generally parallel configuration to provide a second non-perpendicular angle of display relative to the rear panel of the fixture, and wherein the tabs may be received in slots in the rear panel of the fixture to couple the merchandiser thereto.

2. The merchandiser of claim 1, wherein the bottom panel includes a projection extending from a rear edge thereof, and wherein the projection includes a pair of opposed ears that are foldable toward each other.

3. The merchandiser of claim 1, wherein the first and second side panels are offset from each other such that when they are moved to a generally parallel orientation, the first and second side panels are not perpendicular to a plane that contains rear edges of both the first and second side panels.

4. The merchandiser of claim 3, wherein the sheet is reversible to provide an angled display in opposite directions relative to the rear panel of the fixture, and wherein the first and second side panels are pentagonal in shape.

5. The merchandiser of claim 3, wherein the sheet is comprised of a transparent plastic.

6. The merchandiser of claim 5, wherein the transparent plastic is comprised of styrene-butadiene copolymers.

7. The merchandiser of claim 3, further comprising an opening in the bottom panel configured to receive a portion of an informational sign for coupling thereto.

8. The merchandiser of claim 3, wherein a front edge of the tabs abuts a rear surface of the rear panel when inserted in the fixture to resist the weight of merchandise placed in the merchandiser.

9. The merchandiser of claim 3, wherein the merchandiser is configured to lay flat such that multiple merchandisers may be stacked upon one another in a flat position.

10. A merchandiser for displaying greeting cards at a non-perpendicular angle with respect to a rear panel of a display fixture to which the merchandiser may be attached for use, the merchandiser comprising:

a generally planar and unitary sheet comprised of transparent plastic, the sheet comprising first and second side panels separated by a bottom panel;

the bottom panel having a front edge and a rear edge, wherein the front edge and rear edge are opposite and generally parallel to each other;

a projection extending from the rear edge of the bottom panel, the projection having opposed ears which may be folded for insertion into a horizontal slot in the rear panel of the display fixture;

the first side panel joined to the bottom panel at a first fold line and the second side panel joined to the bottom panel at a second fold line, wherein the first and second fold lines are generally parallel to one another, wherein the first and second fold lines are non-perpendicular to the front edge and the rear edge, wherein the first and second side panels may be folded up toward each other to a first generally parallel configuration to provide a first non-perpendicular angle of display relative to the rear panel of the display fixture or folded down toward each other to a second generally parallel configuration to provide a second non-perpendicular angle of display relative to the rear panel of the display fixture, and wherein the first and second side panels are mirror images of each other, the first and second side panels each having a rear edge, a front edge parallel to the rear edge, an upper edge parallel to the respective first or second fold line, and a sloped edge extending between the front edge and the upper edge; and a tab extending from the rear edge of each of the first and second side panels and configured to be inserted into a vertical slot in the rear panel of the display fixture.

11. The merchandiser of claim 10, wherein the first and second side panels each comprise a greater surface area than the bottom panel.

12. The merchandiser of claim 10, wherein the first and second side panels are offset from one another such that the merchandiser provides an angled display when coupled to the rear panel of the display fixture in the first generally parallel configuration or in the second generally parallel configuration.

13. The merchandiser of claim 10, further comprising an opening in the bottom panel configured to receive a portion of an informational sign for coupling thereto.

14. The merchandiser of claim 10, wherein the bottom panel is generally a parallelogram in shape.

15. The merchandiser of claim 10, wherein the first and second side panels have an irregular pentagon shape.

16. The merchandiser of claim 10, wherein the sheet is formed by injection molding and the fold lines are formed at areas of reduced thickness in the sheet.

17. The merchandiser of claim 10, wherein the sheet is die-cut and the fold lines are formed by at least one of perforations and partial cuts.

18. A merchandiser for displaying greeting cards at a non-perpendicular angle with respect to a rear panel of a display fixture to which the merchandiser may be attached for use, the merchandiser comprising:

a generally planar and unitary sheet comprised of transparent plastic, the sheet comprising:

a bottom panel being generally a parallelogram in shape, the bottom panel having a front edge and a rear edge, wherein the front edge and the rear edge are opposite and roughly parallel to each other;

a projection extending perpendicularly from the rear edge of the bottom panel, the projection having opposed ears extending perpendicularly from the projection, wherein the opposed ears may be folded for insertion into a horizontal slot of the rear panel of the display fixture;

a first side panel joined to the bottom panel at a first fold line and a second side panel joined to the bottom panel at a second fold line, wherein the first and second fold lines are generally parallel to one another, wherein the first and second fold lines are non-perpendicular to the front edge and the rear edge, wherein the first and second side panels are mirror images of each other with each having an irregular pentagon shape, wherein the first and second side panels each have a rear edge perpendicular to the fold lines, a front edge perpendicular to the fold lines and parallel to the rear edges, an upper edge perpendicular to the rear edges and parallel to the fold lines, and a sloped edge extending between the front edge and the upper edge of each panel, and wherein the first and second side panels may be folded up toward each other to a first generally parallel configuration to provide a first non-perpendicular angle of display relative to the rear panel of the display fixture or folded down toward each other to a second generally parallel configuration to provide a second non-perpendicular angle of display relative to the rear panel of the display fixture; and a tab extending from the rear edge of each of the first and second side panels proximate the upper edge and configured such that a front edge of the tab abuts against a rear surface of the rear panel when the merchandiser is in use, wherein the tabs and projection may be received in slots of the rear panel of the display fixture.

19. The merchandiser of claim 18, wherein the sheet is formed by injection molding, and wherein the fold lines are formed at areas of reduced thickness on the sheet.

20. The merchandiser of claim 18, wherein the sheet is die-cut and the fold lines are formed by at least one of perforations and partial cuts.

* * * * *